US006738479B1

(12) United States Patent
Sibbald et al.

(10) Patent No.: US 6,738,479 B1
(45) Date of Patent: May 18, 2004

(54) METHOD OF AUDIO SIGNAL PROCESSING FOR A LOUDSPEAKER LOCATED CLOSE TO AN EAR

(75) Inventors: Alastair Sibbald, Maidenhead (GB); Max Andrew Little, Reading (GB)

(73) Assignee: Creative Technology Ltd. (SG)

( * ) Notice: Subject to any disclaimer, the term of this patent is extended or adjusted under 35 U.S.C. 154(b) by 570 days.

(21) Appl. No.: 09/709,446

(22) Filed: Nov. 13, 2000

(51) Int. Cl.[7] ..... H04R 5/00
(52) U.S. Cl. ..... 381/17; 381/1; 381/61
(58) Field of Search ..... 381/17, 18, 61–63

(56) References Cited

U.S. PATENT DOCUMENTS

| | | | | |
|---|---|---|---|---|
| 5,369,710 A | | 11/1994 | Asai | |
| 5,371,799 A | | 12/1994 | Lowe et al. | |
| 5,440,639 A | * | 8/1995 | Suzuki et al. | 381/17 |
| 5,485,514 A | * | 1/1996 | Knappe et al. | 381/63 |
| 5,812,674 A | | 9/1998 | Jot et al. | |

FOREIGN PATENT DOCUMENTS

| | | |
|---|---|---|
| EP | 0 687 130 | 6/1995 |
| EP | 0 827 361 | 3/1998 |
| EP | 0 966 179 | 12/1999 |
| GB | 2 314 749 | 1/1998 |
| GB | 2 337 676 | 11/1999 |
| GB | 2 345 622 | 7/2000 |
| GB | 2 352 152 | 1/2001 |
| JP | 03038695 | 2/1991 |
| JP | 11243598 | 9/1999 |

OTHER PUBLICATIONS

PCT Search Report, dated Feb. 4, 2003.
PCT Search Report, dated Dec. 18, 2002.
Foreign Search Report for GB 0022892.4, dated Mar. 28, 2001.
Foreign Search Report for GB 0022891.6, dated Mar. 26, 2001.

* cited by examiner

*Primary Examiner*—Melur Ramakrishnaiah
(74) *Attorney, Agent, or Firm*—William H. Bollman

(57) ABSTRACT

A method of audio signal processing for a loudspeaker located close to an ear in use, the method consisting of or including:- creating one or more derived signals from an original monophonic input signal, the derived signals being representative of the original signal being scattered by one or more bodies remote from said ear (excluding room boundary reflection or reverberation), combining the derived signal or signals with said input signal to form a combined signal, and feeding the combined signal to said loudspeaker, thereby providing cues for enabling the listener to perceive the source of the sound of the original monophonic input signal to be located remote from said ear.

13 Claims, 13 Drawing Sheets

METHOD OF AUDIO SIGNAL PROCESSING FOR A LOUDSPEAKER LOCATED CLOSE TO AN EAR

BACKGROUND OF THE INVENTION

1. Field of the Invention

Figure 1:
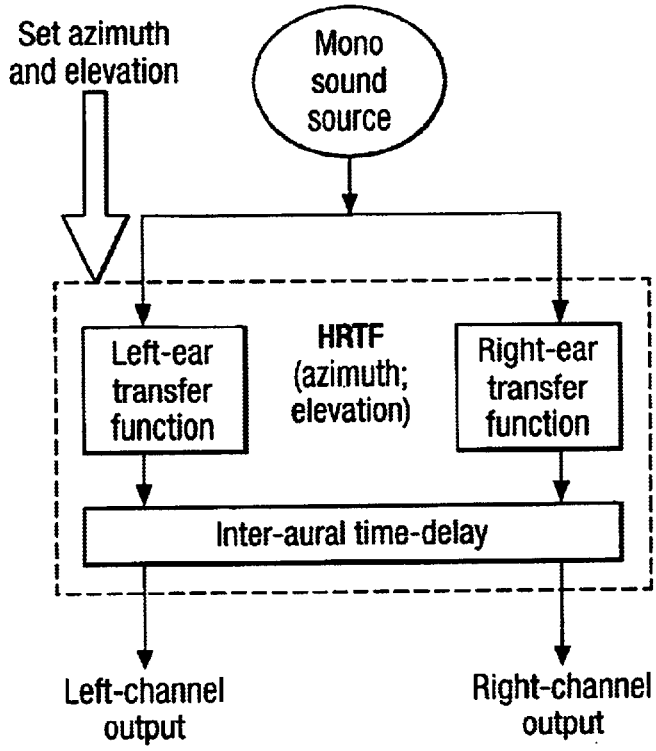

The present invention relates to a method of audio signal-processing for a loudspeaker located close to an ear, and particularly, though not exclusively, to headphone "virtualisation" technology, in which an audio signal is processed such that, when it is auditioned using headphones the source of the sound appears to originate outside the head of the listener.

2. Background

Conventional stereo audio creates sound-images which appear—for the most part—to originate inside the head of the listener, because of the absence of three-dimensional sound-cues. At the present time, there are no adequate and efficient methods for creating a truly effective "out-of-the-head" external sound image, although this has been a long sought-after goal of many audio researchers.

By measuring so-called "Head-Related Transfer Functions" (HRTFs) from a sound-source at specified locations in space, the spatially dependent acoustic processes which act on the incoming sound-waves, caused by the head and outer ear, can be synthesised electronically. This processing, when applied to an audio recording and auditioned on headphones, creates the auditory illusion that the listener hears the recording from a sound-source at that point in space corresponding to the spatial position associated with the HRTF. However, this method is anechoic (no sound-wave reflections are present), and emulates listening to the sounds in an anechoic chamber. The consequent effect is that, although the direction of the sound-source can be emulated reasonably well, its distance is impossible to judge. The sound-source appears to be situated very close to the head.

If an element of artificial reverberation is added to the above processing, then the illusion of providing an external sound-image can be improved a little, but the effects are still not convincing. This is well known for stereo signals, and has been described in our co-pending patent application GB 0009287.4 for monophonic signals.

However, it is known that more adequate "externalisation" effects can sometimes be demonstrated by means of artificial-head recordings, but the recording method does not lend itself to synthesis. Similarly, various so-called "auralisation" signal-processing technologies have been known to create adequate externalisation effects by replicating the impulse response of the entire reverberant properties of a chosen room (typically lasting 4 or more seconds). However, this is achieved at the expense of massive signal-processing effort which is prohibitively impractical for incorporating into, say, portable stereo players, even by present-day standards.

It is an object of the present invention to provide an effective method for creating an external sound-image for headphone listeners, which (a) uses minimal and practicable signal-processing, and (b) which is "neutral", in the sense that it does not necessarily possess specific room characteristics, such that it could be used in conjunction with many different reverberation types, if required.

SUMMARY OF THE INVENTION

According to a first aspect of the present invention, there is provided a method as specified in claims 1–7. A second aspect of the invention provides apparatus as specified in claims 9–13, whilst a third aspect of the invention provides an audio signal as specified in claim 8.

Figure 3:
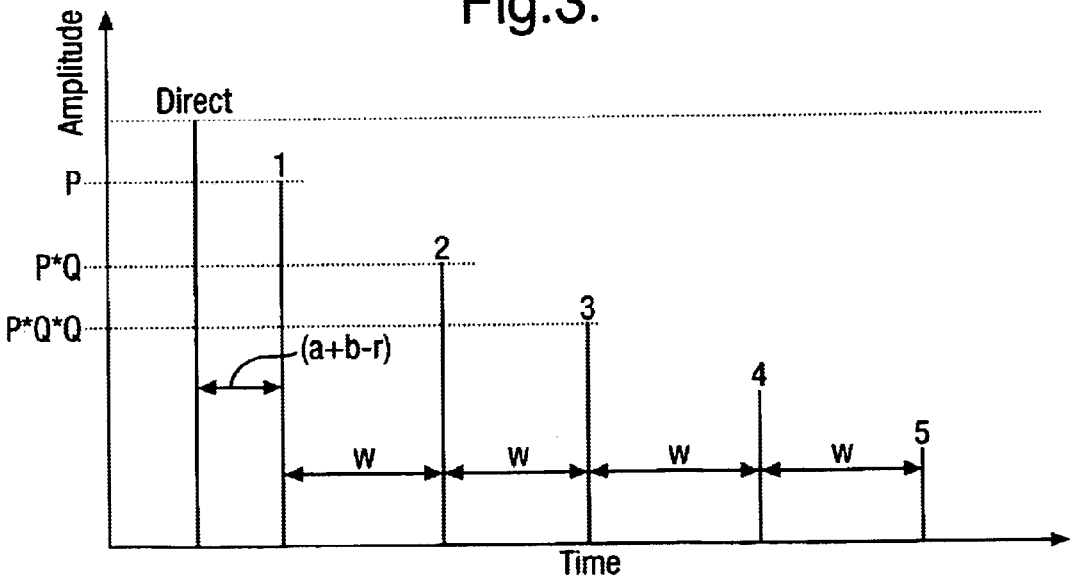
Figure 2:
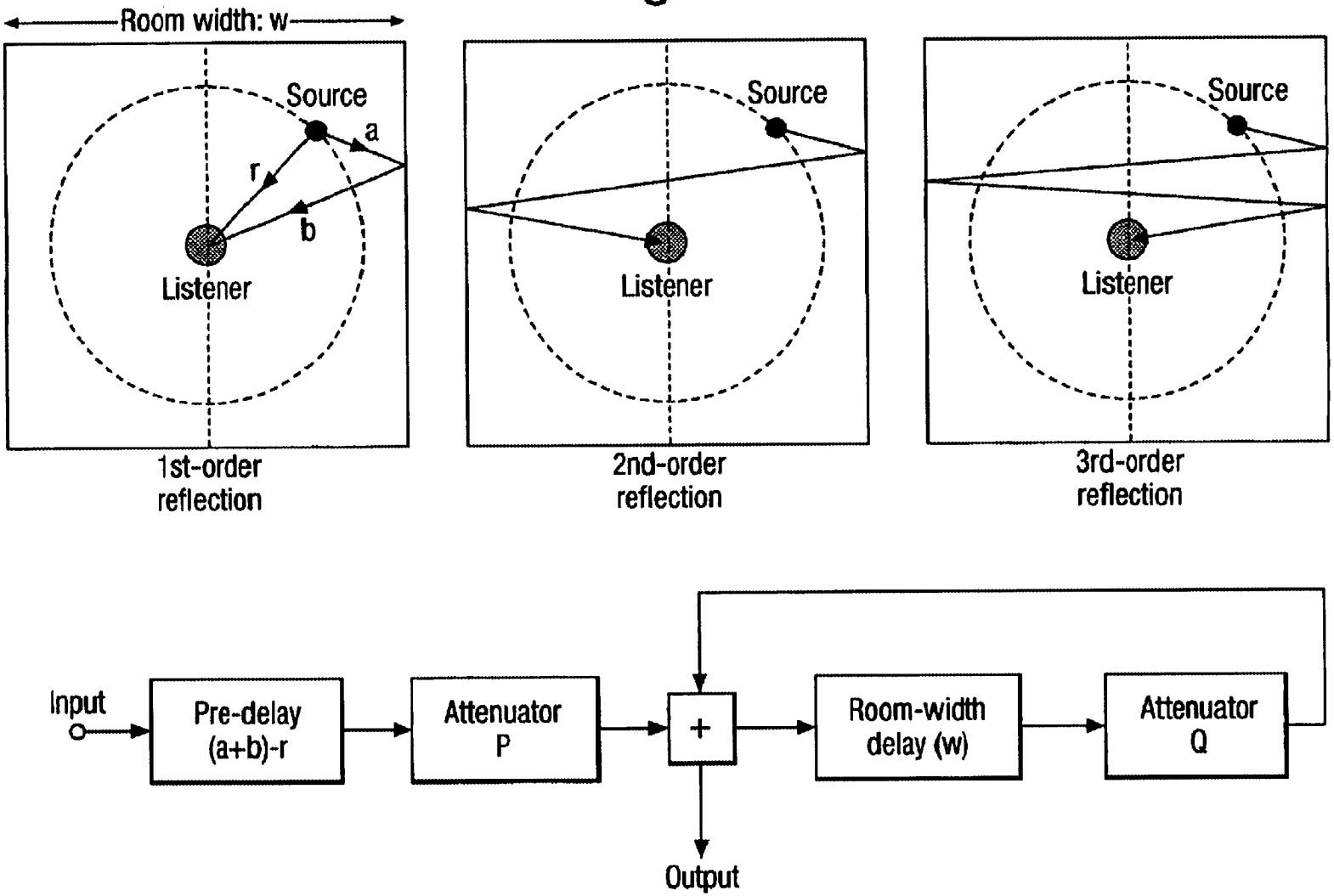
Figure 4:
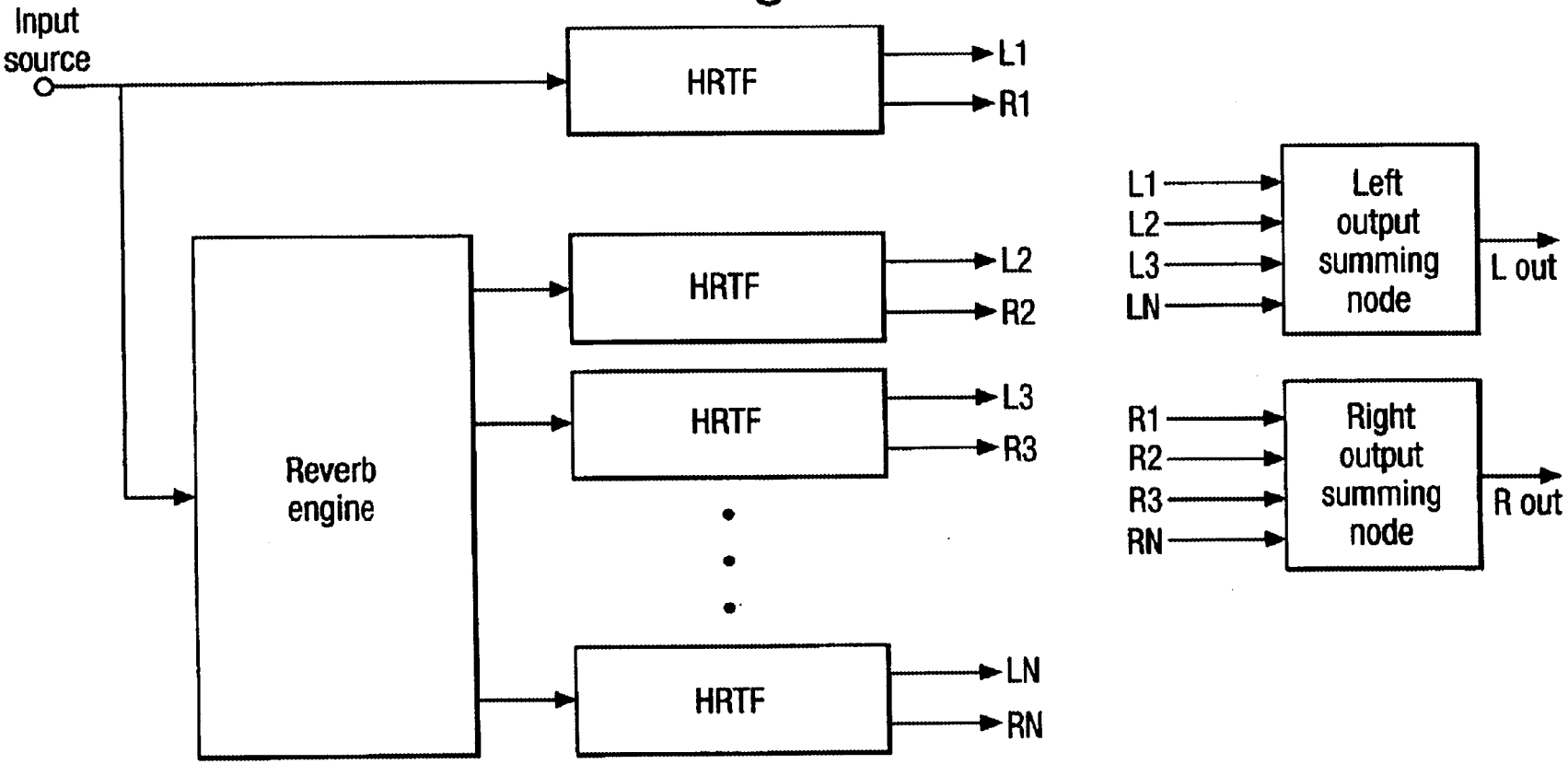
Figure 5:
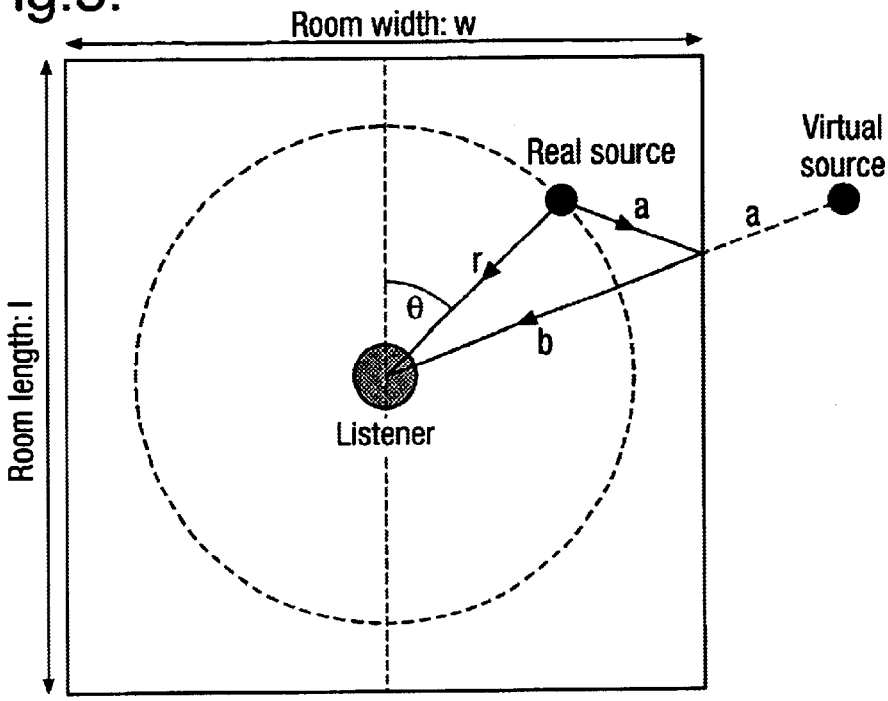
Figure 6:
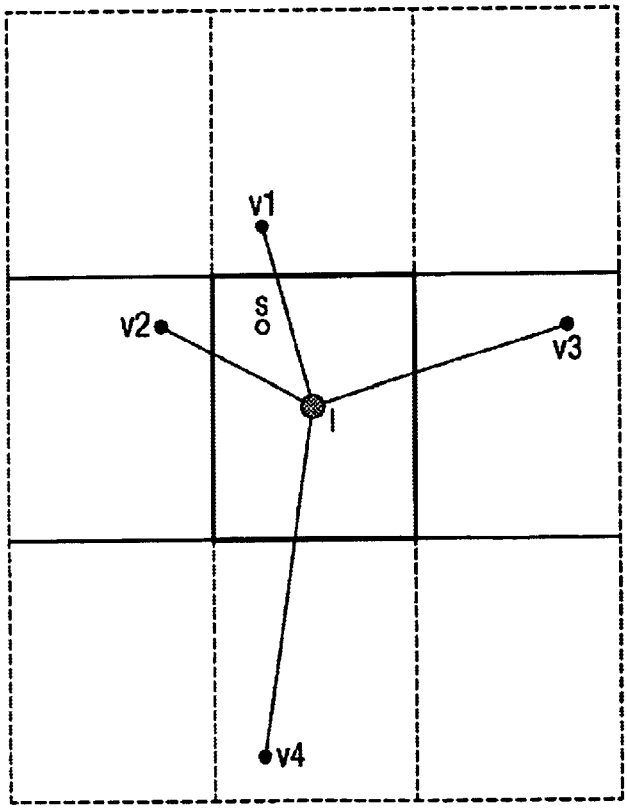
Figure 7:
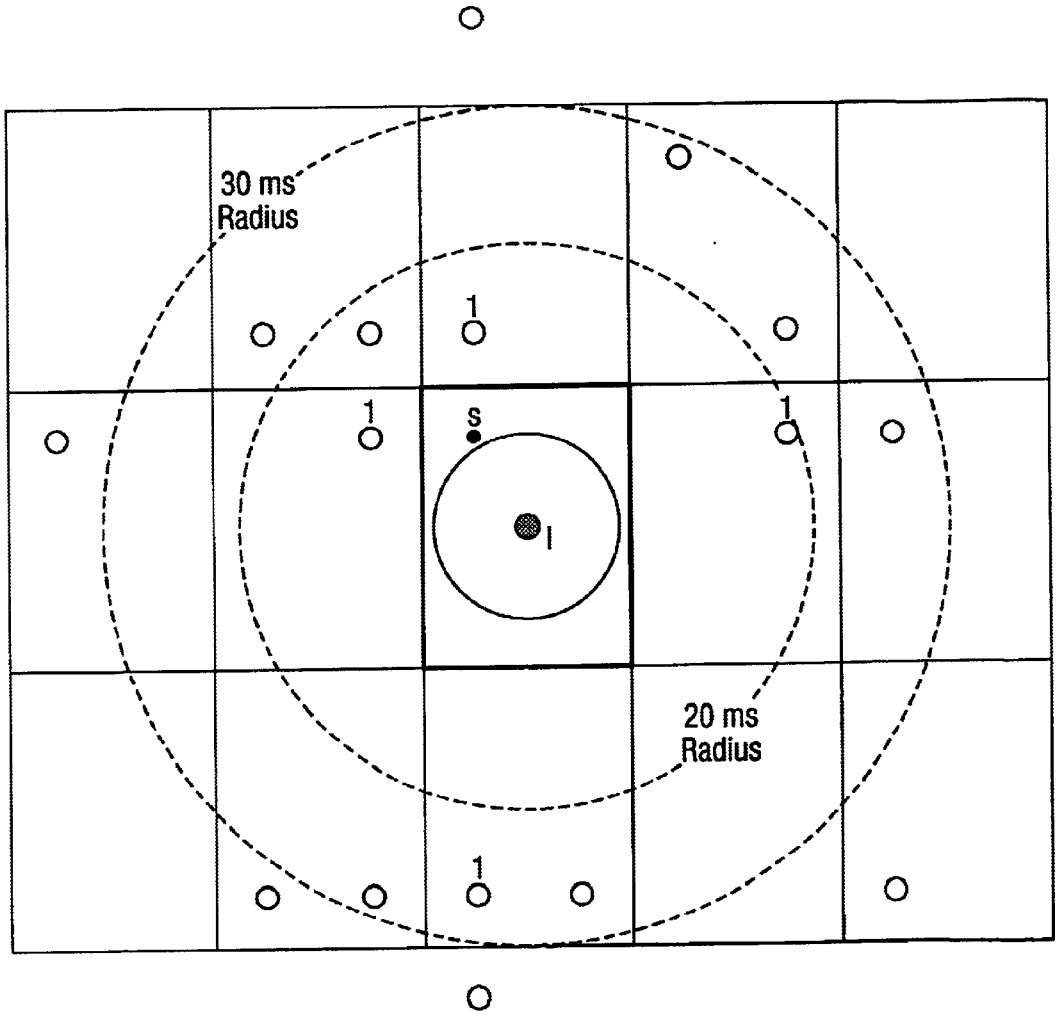
Figure 8:
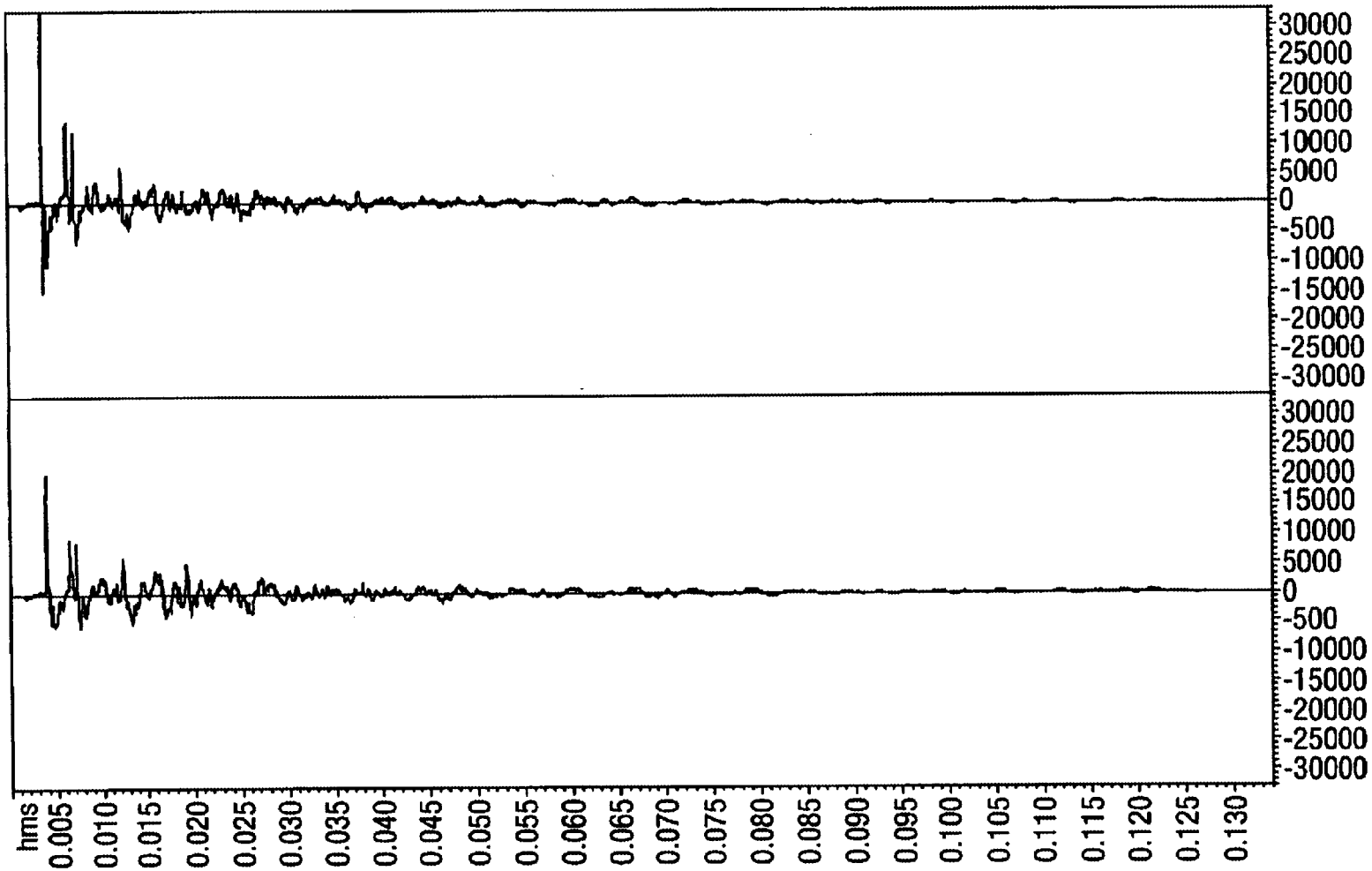
Figure 9:
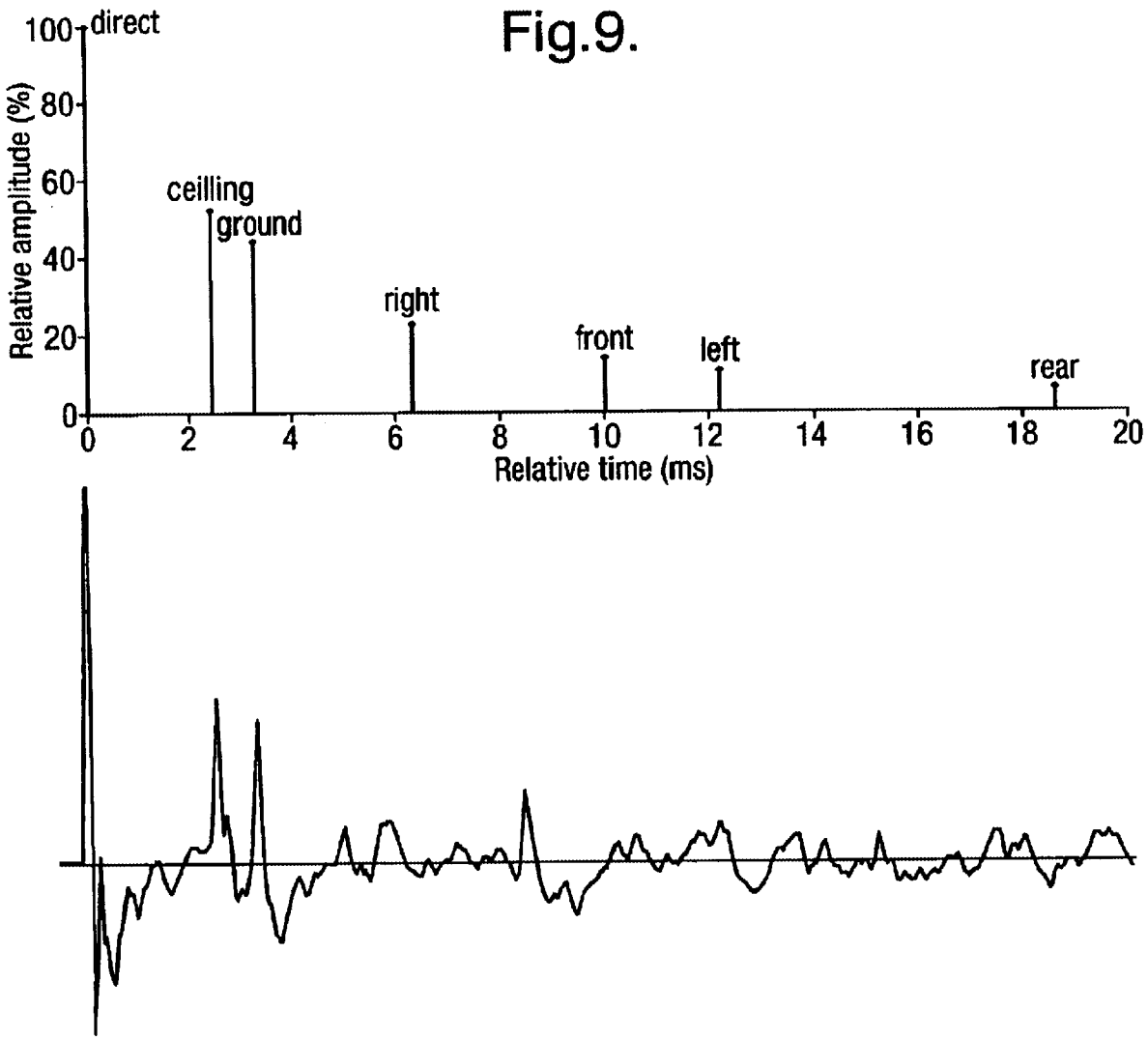
Figure 10A:
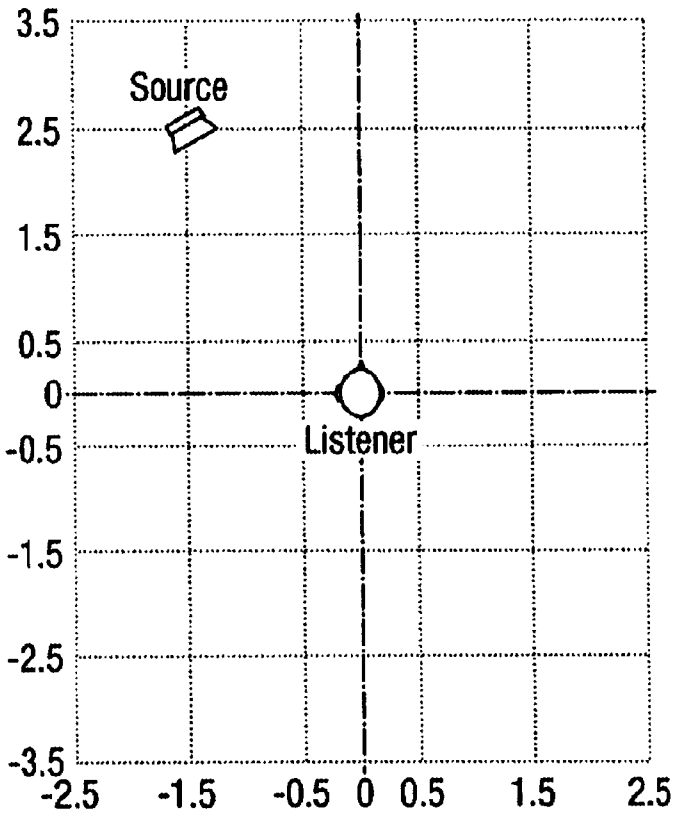
Figure 11:
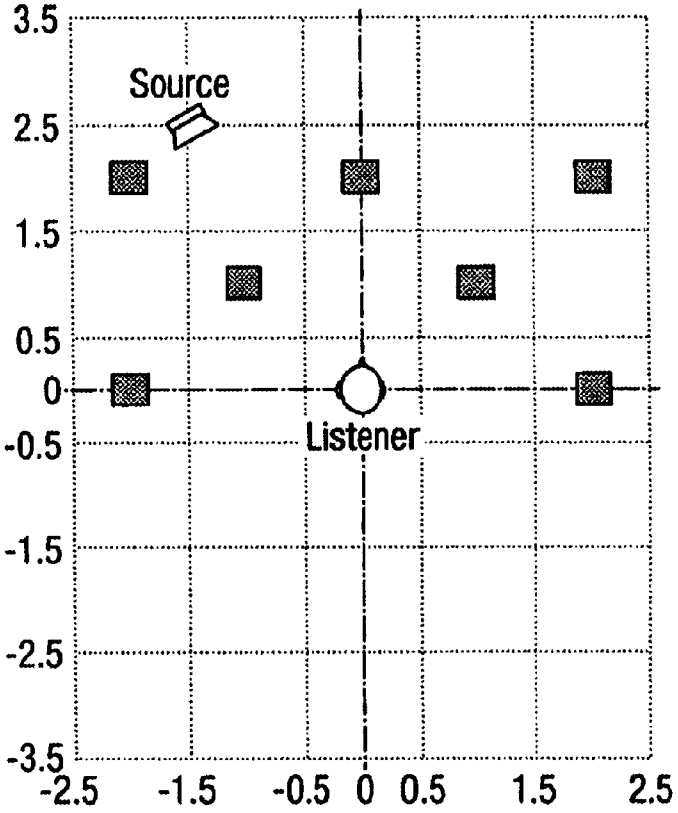
Figure 10B:
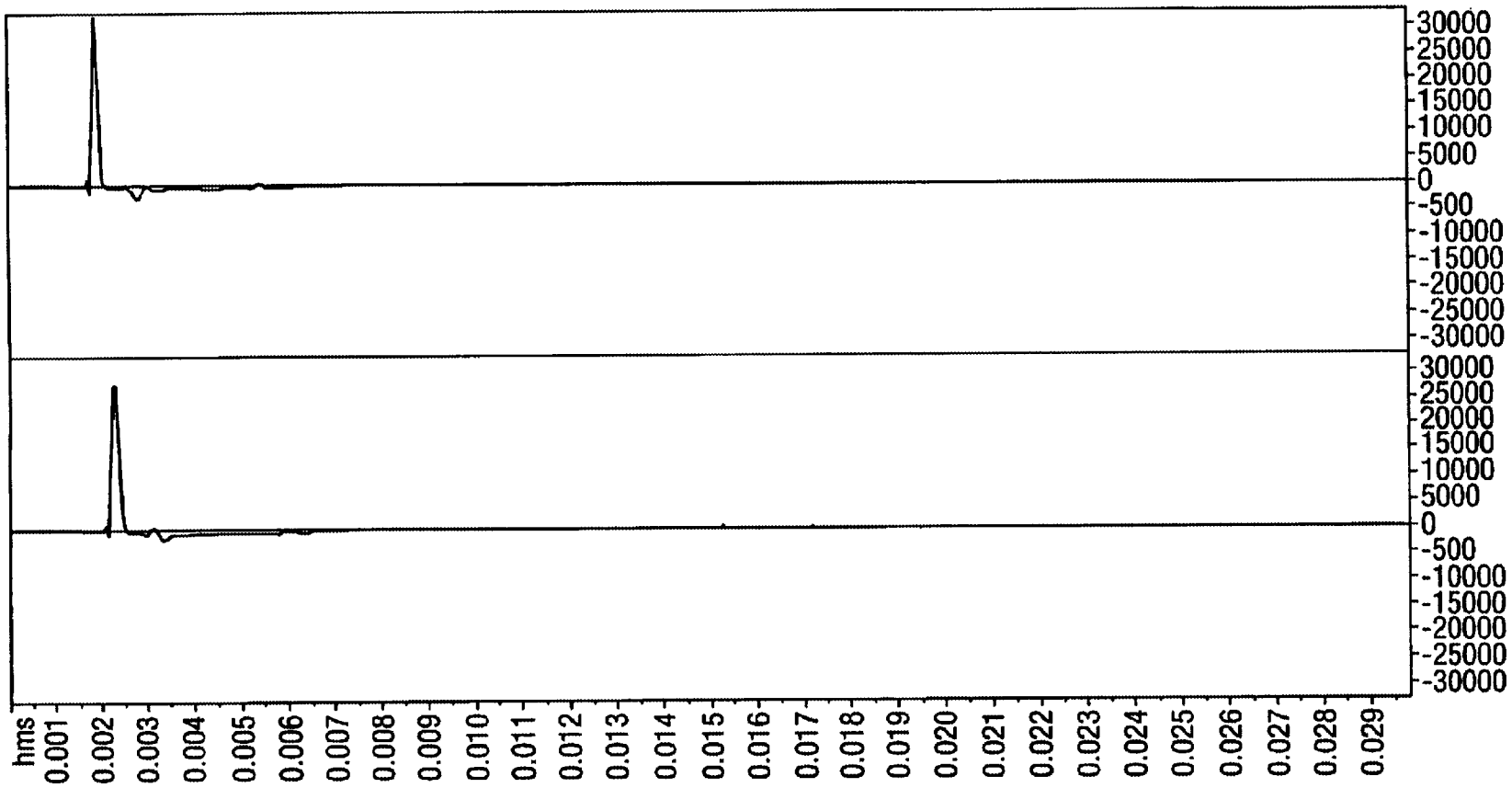
Figure 12:
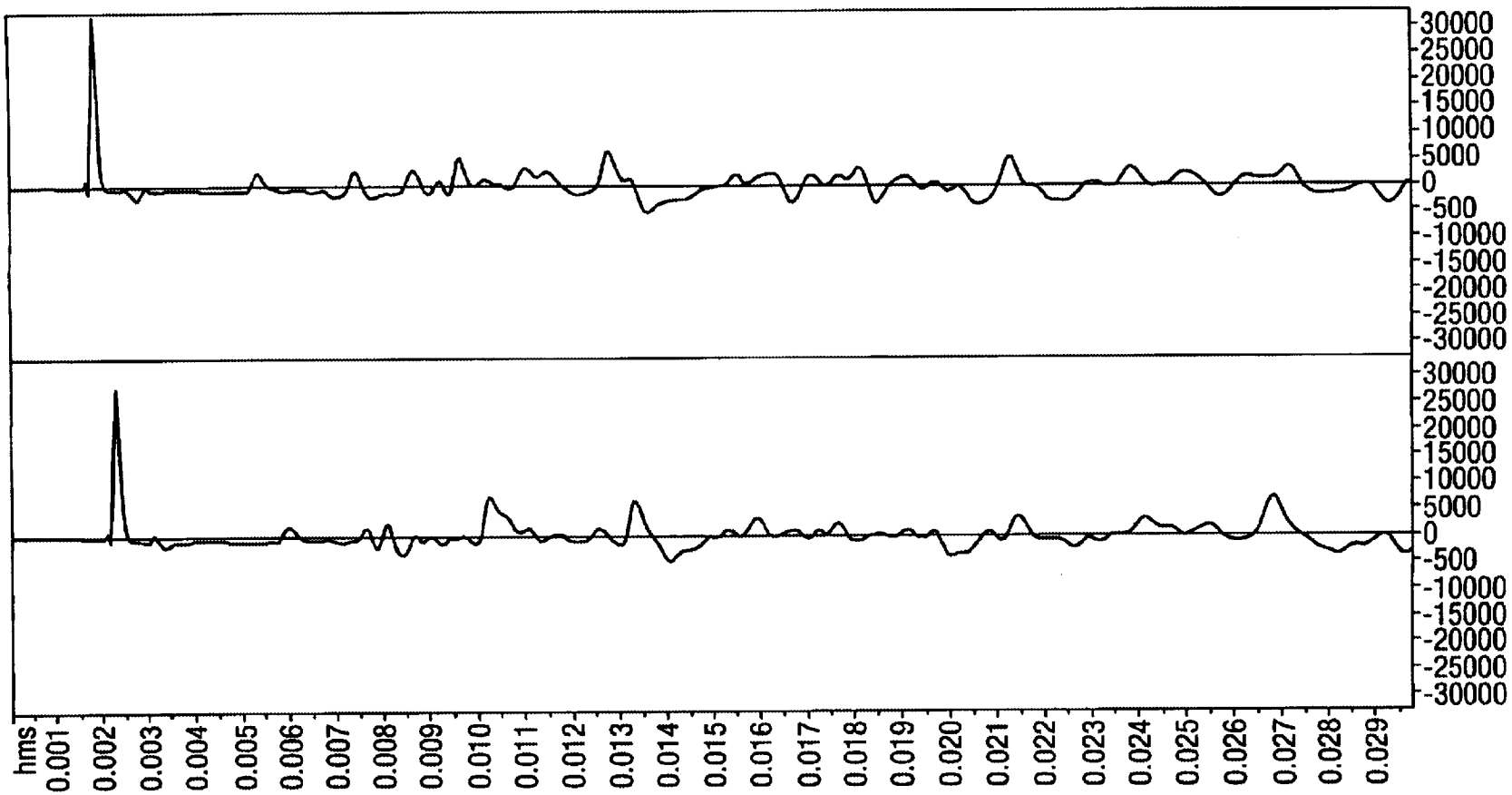
Figure 13:
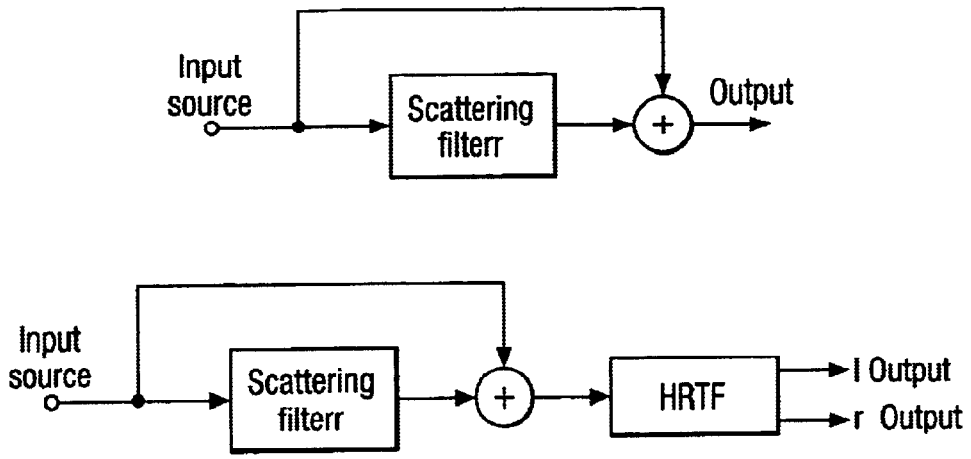
Figure 14:
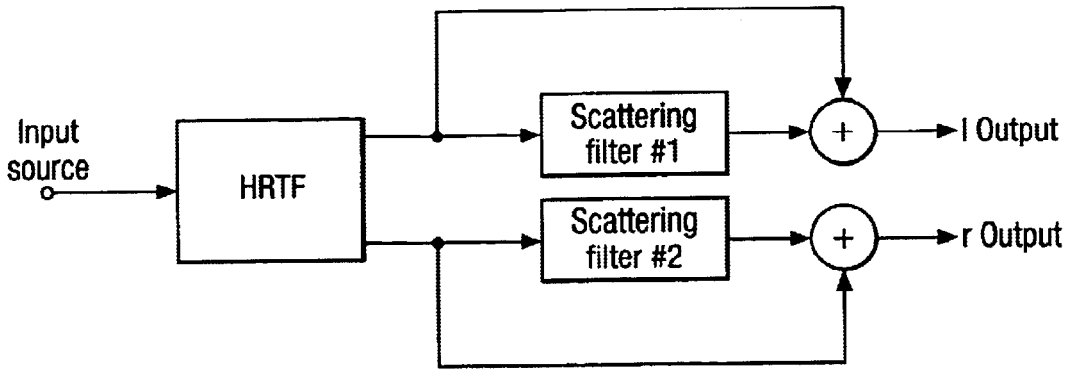
Figure 15:
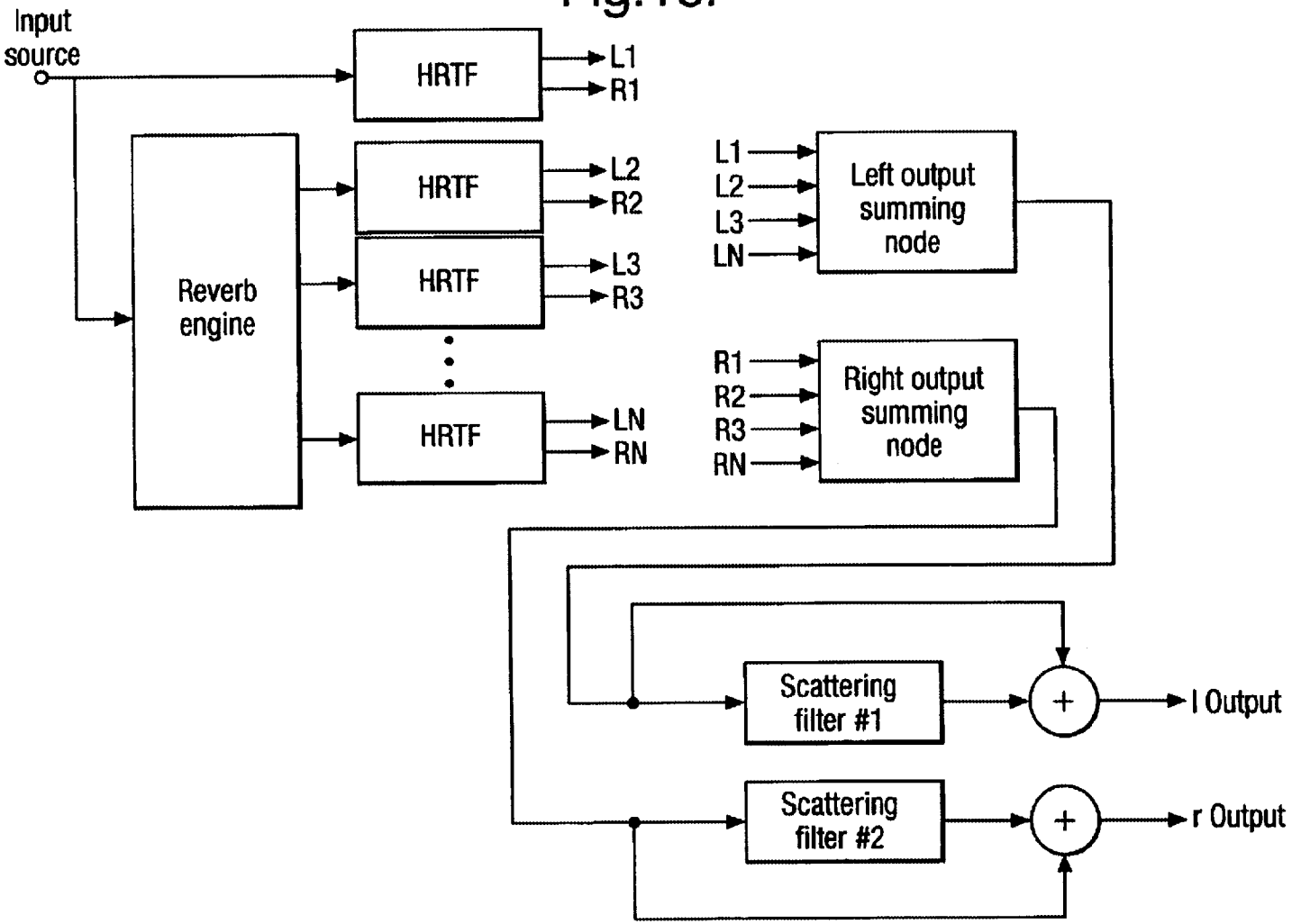
Figure 16:
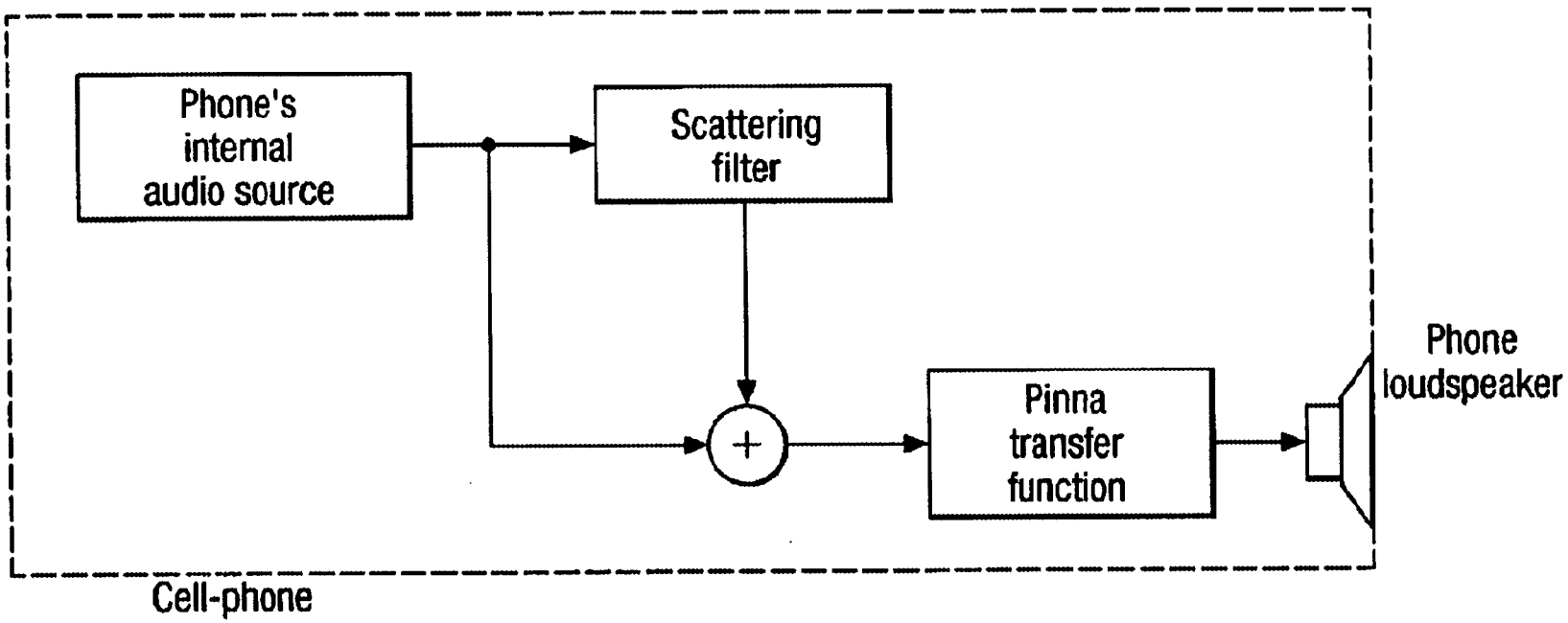

The invention will now be described, by way of example only, with reference to the accompanying schematic drawings, in which:

FIG. 1 shows a block diagram of conventional head-response transfer function (HRTF) signal processing, FIG. 2 shows a known method of creating a reverberant signal, FIG. 3 shows a reverberant signal produced by the method of FIG. 2, FIG. 4 shows a block diagram of a combination of the signal processing of FIGS. 1 and 2, FIG. 5 shows the ray-tracing method of modelling sound propagation in a room in plan view, FIGS. 6 and 7 depict the relative positions of the source, l, listener, 1, and the calculated positions of the virtual sources, for the ray tracing model of FIG. 5, FIG. 8 shows the result of a live recording of a sound impulse in the room modelled in FIGS. 6 and 7, FIG. 9 shows the result of modelling the response to a sound impulse in the same room as that of FIG. 8, together with the corresponding segment of the live recording of FIG. 8, FIG. 10A shows a plan view of a very large two dimensional "plate" of air on which a finite element model was based, FIG. 10B shows the result of a free-field simulation using the model of FIG. 10A, FIG. 11 shows the model of FIG. 10 including scattering from a number of "virtual" bodies, FIG. 12 shows the result of a simulation using the model of FIG. 11, FIG. 13 shows a first embodiment of the present invention, FIG. 14 shows a second embodiment of the present invention, FIG. 15 shows a third embodiment of the present invention, and FIG. 16 shows a fourth embodiment of the present invention.

The present invention is based on the inventors' observation that sound-wave scattering, rather than the simulation of discrete reflections, is an essential element for the externalisation of the headphone sound image. Such scattering effects can be incorporated into presently known, 3D signal-processing algorithms at reasonable and affordable signal-processing cost, and also they can be used in conjunction with known reverberation algorithms to provide improved reverberation effects.

A monophonic sound-source can be processed digitally (FIG. 1) via a "Head-Response Transfer Function" (HRTF), such that the resultant stereo-pair signal contains natural 3D-sound cues. These natural sound cues are introduced acoustically by the head and ears when we listen to sounds in real life, and they include the inter-aural amplitude difference (IAD), inter-aural time difference (ITD) and spectral shaping by the outer ear. When the resultant stereo signal pair is introduced efficiently into the appropriate ears of the listener, by headphones say, then he or she perceives the original sound to be at a position in space in accordance with the spatial location of the HRTF which was used for the signal-processing. (It should be noted that transaural crosstalk-cancellation is required for loudspeaker playback, but that is not relevant here.) Each HRTF comprises three elements: (a) a left-ear transfer function; (b) a right-ear transfer function; and (c) an inter-aural time-delay (FIG. 1), and each HRTF is specific to a particular direction in three-dimensional space with respect to the listener. [Sometimes it is convenient and more descriptive to refer to the left- and right-ear functions as a "near-ear" and "far-ear" function, according to relative source position.]

Typically, it is found that the use of two, 25-tap FIR filters (one for the near-ear filter and one for the far-ear filter), together with an appropriate (ITD) time-delay element, in the range 0 to 650 $\mu$s, provides an effective signal-processing means for implementing an HRTF filter at the conventional sample rates of either 22.05 kHz or 44.1 kHz.

When the HRTF processing (and, if loudspeakers are used, transaural crosstalk-cancellation) is carried out correctly, using high quality HRTF source data, then the effects can be quite remarkable. For example, it is possible to move the image of a sound-source around the listener in a complete horizontal circle, beginning in front, moving around the right-hand side of the listener, behind the listener, and back around the left-hand side to the front again. It is also possible to make the sound source move in a vertical circle around the listener, and indeed make the sound appear to come from any selected position in space. However, when using headphones, the sound-source always appears to be positioned very close to, or just outside of, the head, and it is quite difficult to assess its distance. This is because the synthesis has been an anechoic one, devoid of all sound reflections, and it is believed in prior art teaching that it is these which help us to judge the distance of a sound-source.

An example of prior-art which attempts to solve the problem of creating an out-of-the-head forward image is U.S. Pat. No. 4,136,260, in which it is stated that the inclusion of a spectral notch at around 10 kHz, to represent a supposed pinna reflection, creates a forward image. However, in practise this does not work.

It is generally known that an audio signal can be made to sound more "distant" by the addition of a reverberant signal to the original sound. For example, music processors are available as consumer products for adding sound effects to electronic keyboards, guitars and other instruments, and reverberation is a commonly included feature.

FIG. 2 shows the known method of creating a reverberant signal by means of electronic delay-lines and feedback. Here, the delay-line corresponds to the time taken for a sound-wave to traverse a particular sized room, and the feedback means incorporates an attenuator which corresponds to the sound-wave intensity reduction caused by its additional distance of travel, coupled with reflection-related absorption losses. The upper series of diagrams in FIG. 2 show the plan view of a room containing a listener and a sound-source. The leftmost of these shows the direct sound path, r, and the first-order reflection from the listener's right-hand wall (a+b). Hence, following the arrival of the direct sound at the listener (r ms after leaving the source), it can be seen that the additional time taken for the reflection to arrive at the listener corresponds to (a+b−r). The centre, upper diagram of FIG. 2 shows this sound-wave progressing further to create a second-order reflection. By inspection, it can be seen that the additional path distance travelled is approximately one room-width. The third, right-hand diagram in the series shows the wave continuing to propagate, creating a third-order reflection, and here, by inspection, it can be seen that the wave has travelled about one further additional room-width (compared with the second order reflection).

The lowermost diagram of FIG. 2 shows a block schematic of a simple signal-processing means, analogous to the above, to create a reverberant signal. The input signal passes through a first time-delay {a+b−r} (which corresponds to the time-of-arrival difference between the direct sound and the first reflection), and an attenuator P, which corresponds to the signal reduction of the first-order reflection caused by its longer path-length and absorptive losses. This signal is fed to the summing output node (FIG. 2), where it represents this one, particular, first-order reflection. It is also fed into another time-delay element, w, corresponding to the room-width, and attenuator Q, corresponding to the signal reduction per unit reflection (caused by additional distance travelled and absorptive losses). The resultant signal is also fed back to the output node, which regenerates this latter process, and where the signals represent the second and higher order reflections. Because of the successive delay-and-attenuate reiteration, the signal gradually decays to zero.

The result of this delay-line based reverberation method is depicted in FIG. 3, which shows what the listener would hear. The first signal to arrive, is the direct sound, with unit amplitude, followed by the first-order reflection (labelled "1") after the "pre-delay" time {a+b−r}, and attenuated by a factor of P. Next, the second-order reflection arrives after a further time period of w, and further attenuation of Q (making its overall gain factor P*Q). The iterative process continues ad infinitum, creating successive orders of simulated reflections 2, 3, 4 . . . and so on, with decaying amplitude. By creating several delay-line processing blocks according to FIG. 2, having differing characteristics corresponding respectively to room width, height and length, then it is possible to cross-link them for a more sophisticated reflections simulation.

If such simulated sound reflections and reverberation are added to the virtualisation processing (FIG. 4), then the externalisation effect can be improved a little, but nowhere near as much as might be expected from such careful calculation and application. This virtualisation of stereo including simulated reflections is disclosed in G S Kendall and W L Martens, Proc. Int. Computer Music Conf. 1984, pp. 111–125, which describes in great detail a three-dimensional audio processor (their FIG. 8) intended primarily for headphone use, which incorporates spatial placement of the direct sound via HRTFs ("pinna filtering"), together with both first- and second-order reflection groups and subsequent reverberation.

Another example of prior art is U.S. Pat. No. 5,033,086, which states that it is the "first reflection from the mirror sound source" (i.e. the first-order reflections from the walls; FIG. 1 of that patent) which is of particular significance, and recommends use of simulated reflections having time-delay values of 27 ms and 22 ms.

It is known that the Japanese company, Roland, introduced two musical instrument signal-processors to the UK market in the early 1990s under the name "SoundSpace", in which binaural placement was used, together with 3D-positioned reverberation, and (at least) a simulated ground-reflection. A transaural crosstalk cancellation option was also incorporated, for loudspeaker playback.

A prior art example of the use of stereo headphones with HRTFs and reverberation is U.S. Pat. No. 5,371,799, which describes a binaural (two-ear) system for the purpose of "virtualising" one or more sound-sources. The signal is notionally split into a direct wave portion, an early reflections portion and a reverberations portion; the first two are processed via binaural HRTFs, and the latter is not HRTF processed at all. "The reverberation portion is processed without any sound source location information . . . and the output is attenuated in an exponential attenuator to be faded out".

WO 97/25834 describes a system for simulating a multi-channel surround-sound loudspeaker set-up via headphones, in which the individual monophonic channels are processed so as to include signals representative of room reflections, and then they are filtered using HRTFs so as to become binaural pairs. A further reverberation signal is created from all channels and it is added to the final output stage directly, without any HRTF processing, and so the final output is a mixture of HRTF-processed and non-HRTF-processed sounds.

However, even when great care is taken to adjust the reverberation parameters, it has been discovered that it is difficult to achieve truly convincing "externalisation" effects, even when using quite a complex reverberation engine (featuring all six accurately-simulated first-order reflections, together with eight individual virtual reverberation sources).

It is known that the reverberation properties of a room or enclosed space, caused by the successive, back-and-forth reflection of sound-waves, can be measured using an impulse method, and reproduced by convolving these characteristics on to an audio stream ("auralisation"). Essentially, this records the data represented in FIG. 3 for a particular room by creating an impulse from a sound-source, and then measuring the resultant time-varying disturbance at another point, caused by the arrival of all the various direct and reflected wave-fronts as a function of time.

However, this requires quite a considerable computational resource, because the reverberant effects might last several seconds. For example, if a room has a reverberation time of, say, four seconds (typical of a large recording studio), then the number of samples which must be recorded at the conventional CD sample rate of 44.1 kHz is (4×44,100)= 176,400 samples. Bearing in mind that a typical HRTF requires 2×25 tap filters (50 samples total), then this 4-second room synthesis requires 3,528 times more computational effort than an HRTF synthesis. This is not practical using present DSP technology. Furthermore, the room simulation would be only capable of emulating that one, particular room from which the measurements came. Also, note that twice this amount of processing would be needed for a binaural system, which would be the case for 3D virtualisation.

By modelling the impulse responses of hypothetical rooms during the planning stage, it is possible for architects to listen to a sound synthesis of what the room will sound like before it has been built: this is commonly termed "auralisation", and has application in the design of concert halls and theatres (although it can be fraught with errors).

This method has sometimes been known to create adequate external sound-images, attributed to the exhaustive complexity of the reverberation simulation. However, what is required is a method for creating an effective out-of-the-head sound image via headphones which uses minimal (and practicable) signal-processing power, and which could be used with different reverberation types.

At this stage, it is useful to define and quantify the properties of sound reflections in a typical room, as follows. It is common practise to model the propagation of sound-waves in a room by means of ray-tracing. This method assumes that when a sound wave is reflected from a planar surface, such as a wall, then the process is analogous to an optical reflection: the angle of reflection is equal to the angle of incidence. This is a very crude method of visualising the situation, but it has been adopted widely, probably because of its convenient synergy with reverberation modelling using delay-lines, as described above (FIGS. 2 and 3).

FIG. 5 shows the ray-tracing method applied to a simple rectangular room, depicted here in plan view. The listener is placed in the centre of the room, for convenience, and there is a sound-source to the front and on the right-hand side of the listener, at distance r, and at azimuth angle θ. The room has width w, and length 1. The sound from the source travels via a direct path to the listener, r, as shown, and also via a reflection off the right-hand wall such that the total path length is a+b. If the reflection path is extrapolated backwards from the listener and beyond the wall by its distance from the wall to the source, a, then this specifies the position of the associated "virtual" sound-source. Because there is only a single reflection in the path from the source to listener, it is termed a "first-order" reflection. There are six first-order reflections in all: one from each wall, one from the ceiling and one from the ground.

The geometric calculations which show the quantitative properties of the reflected waves (virtual position, relative distance, and fractional sound intensity) are provided here in Appendix A, from which one can construct the positions of the first-order virtual sources.

In order to illustrate the rationale behind the invention, and the associated quantitative values, we shall compute the virtual sources for a real virtualisation simulation, based on a medium-sized "Listening Room", say 20 feet (~7 meters) in length by 15 feet (~5 meters) wide. (This will be compared to a real measurement, later on.) Let us assume the listener is centrally positioned (x=0; y=0), and that the sound source is to the front and on the left. Listener and source are both are assumed to be about 4 feet (1.2 m) above the floor, i.e. ear height when sitting. (For simplicity, the model will be restricted to two dimensions, at this stage, for it will be shown that two-dimensional data are adequate for implementation of the invention.)

FIG. 6 depicts the relative positions of the source, s, listener, 1, and the calculated positions of the four lateral first-order virtual sources, v1–4 (see Appendix A). (The ceiling and ground reflection virtual sources are not shown.) By further consideration, the "second-order" virtual sources can be determined, too. These are all shown in FIG. 7, as circles (and the first-order virtual sources are labelled "1"). FIG. 7 also shows two dashed circles centred on the listener. The outer circle has a radius of 30 feet, which corresponds, approximately, to 30 ms in time. This represents the area which embraces all of the sources which the listener hears within 30 ms of an event, and is explained later. The inner circle has a radius of 20 feet (20 ms in time). Conceptually, the virtual sources all emit their sound simultaneously with the primary source.

It is very noteworthy that, of the 15 first- and second-order lateral sources, only 4 (just) exist within the first 20 ms, and only 10 of the 15 exist within the first 30 ms after the sound event. One third of all $1^{st}$ and $2^{nd}$ order reflections lie outside the 30 ms time-frame. (This is important, and is referred to later.)

The lateral, $1^{st}$-order reflection data of a 7 meter by 5 meter room is summarised in Table 1 below. It has been assumed that the reflection coefficient of the surfaces is 0.9, and that the listener is centrally positioned across the width of the room, 3.7 meters back from the front wall. The sound source is at an azimuth angle of −30° from the listener at 2.2 meters distance (x=−1.1 meters; y=1.9 meters, with respect to the listener).

TABLE 1

1st-order reflection data computed for a 7 × 5 metre room.

| Source | Azimuth, θ | Elevation, φ | Relative Amplitude (%) | Relative Time Delay (ms) |
|---|---|---|---|---|
| DIRECT SOUND | −30° | 0 | 100 | 0 |
| Left Reflection | −64.2° | 0 | 10.5 | 12.2 |
| Right Reflection | 72.8° | 0 | 22.7 | 6.3 |
| Front Reflection | −11.2° | 0 | 13.6 | 10.0 |
| Rear Reflection | −172.7° | 0 | 5.8 | 18.6 |
| Ground Reflection | −30° | −48.2° | 44.0 | 3.2 |
| Ceiling Reflection | −30° | +43.6° | 52.0 | 2.4 |

The present invention was conceived after the failure to create an adequate externalisation effect for headphone listening according to the prior-art, despite the use of a very comprehensive simulation of room reflections and reverberation. It was not dear why this should be. In order to resolve the problem and discover the shortcoming in their simulation, a series of experiments was conducted.

The inventors used a 7 m×5 m listening room, described in the previous section, as a benchmark for their simulations, with a sound-source position and listener position also as described. (The listener centrally positioned across the width of the room, 3.7 meters back from the front wall, and the sound source at an azimuth angle of −30° from the listener and at 2.2 meters distance (x=−1.1 meters; y=1.9 meters, with respect to the listener).) This arrangement was simulated using a signal processing means based on calculations according to Appendix A, yielding reflection data as shown in Table 1. In addition, a pair of reverberation engines were used in tandem, each creating four virtual reverberant sound sources. Despite this effort, the results were poor. Although the reverberation was audible, it did not help to externalise the sound image convincingly.

Next, a live sound-recording was made in the room, according to the above arrangements. The sound source was a small, 10 cm diameter loudspeaker, mounted in a cylindrical tube, and the recording arrangement was an artificial head (B&K type 5930). A short (4 ms), single cycle sawtooth impulse was driven into the loudspeaker, and the output of the artificial head was recorded digitally. The left- and right-channel recorded waveforms are both shown in FIG. 8 (the left-channel is uppermost).

It is interesting to compare the first 20 ms of the near-ear recording (FIG. 9, lower trace) with the simulation calculations (FIG. 9, upper trace). Note that (1) there is very good agreement between the two for the first two reflections, within the first 4 ms; but also note that, (2) the recorded waveform does not depict the subsequent reflections cleanly (despite the absence of background noise, as evident in the noise-free waveform asymptotes of FIG. 8).

When the recording was auditioned using headphones, the externalisation was judged to be very good.

In an attempt to ascertain the relative importance of different sections of the recording, a digital sound editing program (CoolEdit Pro, by Syntrillium Software) was used to listen, selectively, to different portions of the recording, with the following results.

1. 0–500 ms (entire recording) excellent externalisation
2. 0–100 ms (some reverb truncated) excellent externalisation
3. 0–50 ms (most reverb truncated) excellent externalisation
4. 0–30 ms (all reverb truncated) very good externalisation
5. 0–20 ms (severe truncation) moderate externalisation
6. 0–10 ms (severe truncation) no externalisation; reflections heard as "trills"
7. 0–3 ms (direct sound only) no externalisation whatsoever From this, the somewhat surprising conclusions were as follows:

1. Reverberation does not play an important part in externalisation, because the externalisation is good even when the reverb is (audibly) totally truncated (listening to the 0–30 ms region).
2. First reflections do not play an important part in externalisation, because when they are auditioned with the direct sound in isolation (0–10 ms region), there is no externalisation. The individual reflections can be heard as a rapid "trill".
3. The critical period associated with externalisation is approximately 5–30 ms after the direct sound arrival. (Incidentally, note that many of the early reflections occur after this period (FIG. 7).)

These conclusions are totally contrary to the prior-art beliefs that (a) room-reflection simulation is required for externalisation; (b) complex ray-tracing provides accurate room-simulations; and (c) adequate externalisation can be achieved using reflection and reverberation simulation.

Unfortunately, this does not yet solve the problem. There is, however, another clue about the missing phenomenon required for externalisation. When one listens to sounds out of doors, near to, say, tables and chairs, foliage and the like, then it is quite easy to estimate the range of local sound-sources, in the range, say, from 1 meter to 10 meters distance, but it is much more difficult to do this in a "clear" environment, such as in a field or on the beach. Similarly, an artificial head recording provides good externalisation in a "cluttered" out-of-doors environment. Out-of-doors, of course, there are no room reflections or reverberation.

Consequently, the authors realised that the key feature required for externalisation is not reflections or reverberation, but wave-scattering.

The widely used "image model" described by J B Allen and D A Berkley, J. Acoust. Soc. Am., April 1979, 65, (4), pp. 943–950, proposes the existence of a great many virtual sources in adjacent rooms to the primary one, but it is tacitly assumed that the room is free of scattering objects. When this is simulated accurately, the results do not externalise the headphone image properly, and neither are they convincing in terms of natural reverberation quality.

In reality, however, the presence of physical features in a room, such as loudspeakers, chairs, equipment racks and so on, all scatter the sound-waves from the sound-source. Consequently, the listener receives first the direct sound (by definition), but this is followed quickly by a chaotic sequence of elemental contributions from the scattering objects, even before the first wall reflections arrive at the listener. It is this wave-scattering which is the dominant feature in the 5–30 ms period. Following this, of course, the scattered waves themselves participate in the reflection and reverberation processes.

In order to test this hypothesis, the authors created a scattering simulation, mathematically, together with a control simulation of an anechoic environment.

First, a control simulation of an anechoic environment was created. In the first instance, the modelling was restricted to a two-dimensional format for convenience and simplicity. A finite-element model of a very large 2D "plate"

of air was constructed, and attention focused on a central, 5 meter×7 meter area the size of the Listening Room referred to previously. This model featured a sound-source (an ideal point source), creating a single impulse situated at x=−1.5 m; y=2.5 m from the origin (the centre of the plate), and two detectors (ideal point microphones, to represent the ears), as shown in FIG. 10A, which were spaced 0.22 m apart and centred on the origin. Note that, in effect, there were no walls. The "plate" was so large that this particular simulation was completed before the emitted waves reached the boundaries, and hence the simulation was, in effect, an anechoic or free-field one. An impulse was seeded into the emitter, and the simulated waveforms at the receivers was recorded as a function of time, for one second.

The results were entirely in concordance with expectations, as can be seen by inspection of the waveforms, which are shown in FIG. 10B. There is a "time-of-arrival" difference of about 200 $\mu$s between the two, consistent with the 30° azimuth angle of the source with respect to the detectors, and the signal magnitude at the more distant detector is slightly smaller (because of the additional distance travelled). When the waveform was auditioned using headphones, a "click" was heard with properties similar to an anechoic recording, in that the sound source appeared to be placed vaguely to the left and appeared to be located just inside the listener's head. This was not at all surprising for this control experiment, which was devoid of specific three dimensional sound cues.

Next, the simulation was modified to incorporate some scattering devices, as shown in FIG. 11. Seven devices were used, in order to create a relatively simple wave-scattering area adjacent to the listener. In reality (and three dimensions), these would be analogous to reflective pillars, for example. These simulated scattering devices were each approximately one foot square, and were arranged in a regular matrix about the frontal area of the "listener". Two were placed to the side, and the remainder were placed in rows one and two meters in front of the listener, spaced apart laterally by two meters. Note that there are still no walls present in the simulation.

The audible results were most surprising. The waveforms (FIG. 12) seemed similar in appearance to the characteristics of the "live" recording of FIGS. 8 and 9. Furthermore, when they were auditioned on headphones they possessed good 3D externalisation properties. This was most remarkable, because:

no 3D signal-processing algorithms had been used;

only a two-dimensional air "plate" simulation had been created;

no HRTFs had been used;

the two-microphone receiver arrangement bore little resemblance to an artificial head.

At this stage it was concluded that:

1. Wave-scattering effects are essential for the creation of an effective, external sound-image via headphones ("externalisation").
2. The detailed nature of these wave-scattering effects is not critical for externalisation, and that even 2D-scattering simulations are adequate.
3. Wave-scattering effects can be so effective that supplemental, HRTF-based 3D -sound algorithms are not essential for externalisation.

Clearly, however, it would be reasonable to expect that best externalisation processing means would be analogous to the real-life situation, and comprise (a) HRTF placement of the direct sound source, followed by (b) wave-scattering effects. This produces externalisation with an absence of room effects and reverberation, and hence it is a neutral method.

If, however, it were required to simulate a specific room or acoustic environment, such as an arena or auditorium, then the appropriate reflections and reverberation could be added to the signal processing algorithms, as indicated next.

The previous simulation was repeated, but, this time, four reflective walls were incorporated so as to emulate the 5 meter×7 meter Listening Room. The results were entirely as expected.

The waveforms indicated a "time-of-arrival" difference of about 200 $\mu$s between the two, as before, and the signal magnitude at the more distant detector is slightly smaller. When the waveform was auditioned using headphones, an externalised "click" was heard with properties similar to an echoic recording: the sound was placed somewhere to the left, and outside of, the listener's head.

Note that in all of these simulations, no HRTF processing has been used, and so it would be surprising if any truly accurate 3D sound images were produced. Consequently, in view of the simplicity of the experiment, it is quite remarkable that the externalisation effect observed is so successful.

Wave-scattering data represents wave-born acoustical energy, as a function of time, at one or more points in space. Consequently, this function can be obtained either by measurement or synthesis at any point in the "acoustic chain" from the sound-source to the listener's eardrum. For example, it could be measured either: (a) in a free-field; (b) adjacent to the head; (c) at the entrance to the ear-canal, or (d) adjacent to the eardrum. These examples can be used to define four modes of scattering data, respectively, from which four distinct modes of scattering filter can be created, as follows.

Scatter Mode 1: Free-field

This filter mode is free of all head-related influences, and represents the effect of local scattering in a free-field, anechoic environment.

Scatter Mode 2: Adjacent to Head

This mode represents the effect of local scattering in a free-field, anechoic environment, as measured in the proximity of an artificial head. Similar to Mode 1, but there is an increase in gain at low-frequencies because of the in-phase, back-reflected waves.

Scatter Mode 3: Integral Pinna Characteristics

This mode represents the effect of local scattering in a free-field, anechoic environment, as measured using an artificial head without ear-canal emulators. This means that outer-ear (pinna) characteristics are "built-in" to the data.

Scatter Mode 4: Integral Pinna and Ear-canal Characteristics

This mode represents the effect of local scattering in a free-field, anechoic environment, as measured using an artificial head with integral ear-canal emulators, and hence both the outer-ear and ear-canal characteristics are incorporated with the data.

In practise, Modes 1, 2 and 3 are perhaps the most relevant and convenient to use. Mode 1 is free of all head-related influences and mode 2 is free of pinna influences, whereas Mode 3 incorporates all the relevant elements of an HRTF such that its output could be added directly to other, related, HRTF-processed audio.

Mode 1 is appropriate for loudspeaker reproduction systems remote from the ear. (Although we are concerned here primarily with headphone externalisation, it must be noted that the present invention can be used in conjunction with prior-art reverberation systems for enhanced quality and effect.) Modes 1 and 2 are also appropriate for use in headphone synthesis systems for processing audio prior to HRTF processing. Mode 3 is appropriate for use in headphone synthesis systems for processing audio in parallel with associated, additional HRTF processing, for subsequent combination of the two.

In order to synthesise 3D-sound, the complete acoustic chain (from the sound-source to the listener's eardrum) must be simulated. In order to integrate a wave-scattering component into this simulation chain, its data must be consistent with its position in the chain. However, note that the simulation process includes both the listener and the listening means—either loudspeakers or headphones—and this latter factor influences the type of HRTFs which are used. Essentially, if the synthesis is for headphone listening, then the HRTFs must correspond to head and outer-ear data only. (This means either that they must be measured from an artificial head without an ear-canal simulator present, or, if a canal is present, its effects must be compensated for.) On the other hand, if the synthesis is for loudspeaker listening, then the listener's own outer-ear function will be present in the listening chain and so "normalised" HRTFs must be used in the synthesis. ("Normalised" HRTFs are devoid of the major, common resonant features, and are created by taking the quotient of two chosen HRTFs.)

So for headphones listening, either Mode 1 or Mode 2 scattering filters are required in series with an HRTF, or Mode 3 scattering filters in parallel with HRTF processed audio.

In practise, it is not convenient to measure Mode 3 scattering data, because every single measurement would require a specific, physical scattering scenario, together with an artificial head recording in an anechoic chamber. Nor is it simple to generate this data, because of the complexity of incorporating direction dependent pinna characteristics into the finite-element model. However, as the scattering effects and pinna effects occur serially, it is simple to concatenate a Mode 1 or Mode 2 scattering filter together with an HRTF (or one of the pinna functions of the HRTF), and create the Mode 3 data. However, this poses the question about which particular HRTF should be used. Whereas the direct-sound wave has a clear, single vector, and therefore can be represented by an apparent spatial direction at the head of the listener, the scattered wave data represents the somewhat chaotic combination of a multitude of elemental waves, all possessing different vectors. In short, there is no distinct spatial direction associated with the scattered data, so which HRTF should be chosen?

In practise, it is reasonable and practical to use a so-called "diffuse-field" HRTF for processing scattered-wave audio. The spectral data could be obtained from an artificial head recording of white noise in an echoic environment, which would represent an "average", or non direction-specific HRTF. An alternative method is to compute the left- and right-ear spectral averages from all the HRTFs in an entire spatial library.

In short, then, the use of Mode 1 or Mode 2 scattering data together with a diffuse-field HRTF is satisfactory for creating a Mode 3 scattering filter.

The chosen Mode of the scattering filter in the synthesis chain is dependent on whereabouts it is introduced into the chain. For example, if the scattering data are measured in the free-field, prior to reaching the listener's head (Mode 1), then during synthesis it would be appropriate to couple the associated scattering filter into the 3D-sound synthesis chain in parallel with the direct sound path, as shown in FIG. 13, prior to the HRTF processing (as in FIG. 1). In this way, the synthesis follows reality, with the direct-sound being HRTF processed, and the scattered sound being HRTF processed.

In certain circumstances, it is possible to economise on the audio processing. For example, if one wished to create a virtual loudspeaker via headphones, at azimuth 30°, and the scattering environment was largely frontal (as in FIG. 11), then the scattered waves would be incident largely from the same direction as the direct sound, and so one could use the same HRTF to process both direct and scattered sound. Although this is not a perfect emulation, it is satisfactory and uses less processing power. This economical approach is especially useful for multi-channel emulation (such as 5.1 channel cinema surround-sound).

The invention can be implemented in a variety of ways, as listed below. A common feature in all of these implementations is the use of a filter (such as a finite-element response (FIR) filter, as known to those skilled in the art) to implement the wave-scattering effects. The basic wave-scattering filter is implemented as shown in FIG. 13 (upper). The input signal is fed both into (a) the scattering filter, and (b) an output summing node, and the summing node combines the input signal itself (representing the direct-signal) with the scattered component. Thus, the output signal contains the direct signal, followed closely in time by the wave-scattered elements.

The wave-scattering data, from which the associated filter coefficients can be calculated, can be attained either directly, by measurement, or indirectly, by mathematical modelling as described earlier. Typically, the wave-scattering critical time period lies in the range 0 to 35 ms after the direct sound arrival (although this can be reduced to the period 5 to 20 ms if slightly less effectiveness can be tolerated). Furthermore, we have observed that the bandwidth of the scattered audio can be restricted to about 5 kHz without detriment (i.e. 11 kHz sampling rate), and used in conjunction with a 22.05 or 44.1 kHz bandwidth direct-sound signal. This means that a wave-scattering emulation at 11 kHz for the period from 5 ms to 25 ms would require only 20×11 taps (a 220-tap FIR filter). Alternatively, a co-pending patent application describes a highly efficient means to synthesise such wave-scattering effects.

The simplest implementation of the invention is the basic wave-scattering filter, as described above and shown in FIG. 13 (upper). This has application in cell-phone technology, as described in co-pending patent application GB 0009287.4 (which is hereby incorporated herein by reference), in lieu of the reverberation engine to provide a non-HRTF based monophonic virtualisation.

By appropriate measurement or modelling means, a left-right "complementary pair" of scattering filters can be created. These are derived from, and correspond to, measurements of the wave-scattering phenomenon at the left-ear and right-ear positions of a virtual listener. Although the scattering characteristics exhibited at these positions are generally similar, the two derivative complementary filters are different in terms of detail. This decorrelated pair is more effective for creating externalisation when symmetry exists in the virtualisation arrangements, for example, when virtualising the centre channel of a "5.1" channel movie surround system.

There are two basic options for incorporating the invention into an HRTF-based virtualisation. Firstly, a single wave-scattering filter can be incorporated serially into the input port of the HRTF processing block, as shown in FIG. 13 (lower). This is economical in terms of processing load, although not quite so effective as the complementary pair configuration (next).

A better option than the above is to incorporate a complementary-pair of wave-scattering filters serially into the output ports of the HRTF processing block, as shown in FIG. 14. This is more representative of reality, where slightly differing scattering effects are perceived at each ear, although the signal-processing burden is greater.

In light of the above the disclosures, it will be obvious to those skilled in the art that there are a variety of ways to incorporate the invention into prior-art reverberation engines, such as that of FIG. 4. For example, a complementary pair of wave-scattering filters (WSF) could be incorporated into the output streams after all the individual signals (direct, reflected and reverberant) had been virtualised and combined, and prior to transmission to the ears of the listener, as shown in FIG. 15.

Alternatives would be to use a single WSF in the input stream, or pairs of WSFs in the output ports of each HRTF (this latter option is costly in signal-processing terms).

If it is required to virtualise a multi-channel surround-sound system for headphone listening, such as the Dolby Digital 5.1 format, then several options exist. The simplest method is use of a single WSF (FIG. 13 (lower)) prior to each of the five HRTFs. A better method is to use the complementary-pair WSF method (FIG. 14). Another method would be to use a single WSF complementary-pair in the final output stage, after the five HRTF outputs have been summed together, in an analogous manner to the configuration of FIG. 15.

We have described the use of monophonic virtualisation applied to cell-phones in co-pending patent application GB 0009287.4. The present invention can be substituted directly for the reverberation block used on this application, as shown in FIG. 16.

Although the embodiments described have been related to the use of pad-on-ear or circumaural type driver units, other types of loudspeaker such as, for example, units adapted to be placed in the ear canal can be used as an alternative, including those featuring noise cancellation systems.

In summary, the present system provides effective externalisation of sound images for headphone listeners having the following advantages:

- No additional signal processing is required (such as reflection simulation).
- It is "neutral", and can be supplemented by any required reverberation type (Room/Arena).
- It is flexible—the size of the scattering algorithm can be traded off against its effectiveness, so as to suit different types of DSP.
- It can be used with mono virtualisation (for cell-phone applications, for example).

APPENDIX A

Room Reflection Calculations

By simple geometric calculation, the azimuth angle of the virtual source, together with its distance, can be calculated. If this is done for the four walls, ground and ceiling, one can use the data to simulate room reflections and assess their contribution to virtualisation. The following equations use room-width (w), room length (l), listener and source height (h), source-to-listener distance (r), source azimuth (θ), and assume that the listener is centrally located. The "virtual source relative distance" is the difference between the direct path to the listener from the source, and the indirect path (i.e. virtual source-to-listener). This is important for calculating the arrival times at the listener of the individual reflections, with respect to the initial, direct sound arrival (sound travels 1 meter in approx. 2.92 ms). The is fractional intensity of the reflection, with respect to the direct sound, can be calculated using the inverse square law to be: (r/virtual source relative distance)$^2$.

A1. Near-side Reflection $$\text{Virtual source azimuth: } \theta_{near-side} = \tan^{-1}\left(\frac{(w - r\cdot\sin\theta)}{r\cdot\cos\theta}\right) \quad (1)$$

$$\text{Virtual source relative distance: } D_{near-side} = \sqrt{(w - r\cdot\sin\theta)^2 + (r\cdot\cos\theta^2)} - r \quad (2)$$

$$\text{Fractional intensity: } FI_{near-side} = \left(\frac{r}{\sqrt{(w - r\cdot\sin\theta)^2 + (r\cdot\cos\theta^2)} - r}\right)^2 \quad (3)$$

A2. Far-side Reflection $$\text{Virtual source azimuth: } \theta_{far-side} = \tan^{-1}\left(\frac{(w + r\cdot\sin\theta)}{r\cdot\cos\theta}\right) \quad (4)$$

$$\text{Virtual source relative distance: } D_{far-side} = \sqrt{(-w - r\cdot\sin\theta)^2 + (r\cdot\cos\theta^2)} - r \quad (5)$$

$$\text{Fractional intensity: } FI_{near-side} = \left(\frac{r}{\sqrt{(-w - r\cdot\sin\theta)^2 + (r\cdot\cos\theta^2)} - r}\right)^2 \quad (12)$$

A3. Frontal Reflection $$\text{Virtual source azimuth: } \theta_{frontal} = \tan^{-1}\left(\frac{(r\cdot\sin\theta)}{l - r\cdot\cos\theta}\right) \quad (7)$$

$$\text{Virtual source relative distance: } D_{frontal} = \sqrt{(r\cdot\sin\theta)^2 + (l - r\cdot\cos\theta^2)} - r \quad (8)$$

$$\text{Fractional intensity: } FI_{near-side} = \left(\frac{r}{\sqrt{(r\cdot\sin\theta)^2 + (l - r\cdot\cos\theta^2)} - r}\right)^2 \quad (9)$$

A4. Rearward Reflection $$\text{Virtual source azimuth: } \theta_{rearward} = 90° + \tan^{-1}\left(\frac{(l + r\cdot\cos\theta)}{r\cdot\sin\theta}\right) \quad (10)$$

$$\text{Virtual source relative distance: } D_{rearward} = \sqrt{(r\cdot\sin\theta)^2 + (l + r\cdot\cos\theta^2)} - r \quad (11)$$

$$\text{Fractional intensity: } FI_{near-side} = \left( \frac{r}{\sqrt{(r \cdot \cos\theta)^2 + (l + r \cdot \cos\theta^2)} - r} \right)^2 \quad (12)$$

A5. Ground Reflection $$\text{Virtual source azimuth: } \theta_{ground} = \theta \quad (13)$$

$$\text{Virtual source depression: } \phi_{ground} = \tan^{-1}\left(\frac{2h}{r}\right) \quad (14)$$

$$\text{Virtual source relative distance: } D_{ground} = 2\sqrt{h^2 + \left(\frac{r}{2}\right)^2} - r \quad (15)$$

$$\text{Fractional intensity: } FI_{ground} = \left( \frac{1}{\left(\frac{2h}{r}\right)^2 + 1} \right) \quad (16)$$

A6. Ceiling Reflection (As for ground reflection, but substituting {room height−h} for {h}, and using the depression angle for the elevation angle value.)

What is claimed is:

1. A method of audio signal processing for a loudspeaker located close to an ear in use, the method comprising:

a) creating one or more derived signals from an original monophonic input signal, the derived signals being representative of the original signal being scattered by one or more bodies remote from said ear (excluding room boundary reflection or reverberation), b) combining the derived signal or signals with said input signal to form a combined signal, and c) feeding the combined signal to said loudspeaker, thereby providing cues for enabling the listener to perceive the source of the sound of the original monophonic input signal to be located remote from said ear.

2. A method as claimed in claim 1 in which the derived signals or derived signal sets are created by using a finite impulse response (FIR) filter having a multiplicity of taps to emulate sound scattered by said bodies.

3. A method as claimed in claim 1 in which room boundary effects and/or reverberation are included.

4. An audio signal produced by a method as claimed in claim 1.

5. Apparatus including one or more loudspeakers adapted for use close to an ear, the apparatus including signal processing means for performing a method as claimed in claim 1.

6. Apparatus as claimed in claim 5 including a mobile phone or cellular phone.

7. Apparatus as claimed in claim 5 including an electronic musical instrument.

8. Apparatus as claimed in claim 5 including a reverberation generator.

9. Apparatus as claimed in claim 5 including control means operable to select parameters of the signal processing.

10. A method of audio signal processing for a loudspeaker located close to an ear in use, the method comprising:

a) creating one or more derived signals from an original monophonic input signal, the derived signals being representative of the original signal being scattered by one or more bodies remote from said ear (excluding room boundary reflection or reverberation), b) combining the one or more derived signals with said input signal to form a combined signal, a) modifying the spectral characteristics of the combined signal using an ear response transfer function, and b) feeding the modified combined signal to said loudspeaker, thereby providing cues for enabling the listener to perceive the source of the sound of the original monophonic input signal to be located remote from said ear.

11. A method of audio signal processing for a left loudspeaker and a right loudspeaker located close to the ears of a listener in use, the method comprising:

a) creating one or more derived signals from an original monophonic input signal, the derived signals being representative of the original signal being scattered by one or more bodies remote from said ear (excluding room boundary reflection or reverberation), c) combining the one or more derived signals with said input signal to form a combined signal, b) modifying the spectral characteristics of the combined signal using a head response transfer function to provide a modified left combined signal and a modified right combined signal, and c) Feeding the modified left and right combined signals to respective loudspeakers, thereby providing cues for enabling the listener to perceive the source of the sound of the original monophonic input signal to be located remote from said ears.

12. A method of audio signal processing for a left loudspeaker and a right loudspeaker located close to the ears of a listener in use, the method comprising:

a) applying a head related transfer function to an original monophonic input signal to provide a left ear signal and a right ear signal, b) creating a pair of derived signal sets from said left ear signal and said right ear signal respectively, the derived signal sets being representative of the original signal being scattered by one or more bodies remote from respective ears (excluding room boundary reflection or reverberation), c) combining the respective derived signal sets with the left ear signal and the right ear signal to form a left combined signal and a right combined signal, d) feeding the modified left and right combined signals to respective loudspeakers, thereby providing cues for enabling the listener to perceive the source of the sound of the original monophonic input signal to be located remote from said ears.

13. A method as claimed in claim 12 in which the pair of derived sets of signals are at least partially decorrelated with one another at frequencies below 400 Hz.

* * * * *